US011028333B2

(12) United States Patent
Dowding et al.

(10) Patent No.: US 11,028,333 B2
(45) Date of Patent: Jun. 8, 2021

(54) LUBRICATING OIL ADDITIVES

(71) Applicant: Infineum International Limited, Abingdon (GB)

(72) Inventors: Peter J. Dowding, Wantage (GB); Elin J. Eis, Houmantorp (SE)

(73) Assignee: Infineum International Limited

( * ) Notice: Subject to any disclaimer, the term of this patent is extended or adjusted under 35 U.S.C. 154(b) by 21 days.

(21) Appl. No.: 16/745,522

(22) Filed: Jan. 17, 2020

(65) Prior Publication Data

US 2020/0148969 A1 May 14, 2020

Related U.S. Application Data

(62) Division of application No. 15/810,226, filed on Nov. 13, 2017, now Pat. No. 10,577,555.

(51) Int. Cl.

| | |
|---|---|
| ***C10M 129/42*** | (2006.01) |
| ***C10M 135/10*** | (2006.01) |
| ***C10M 133/16*** | (2006.01) |
| ***C10M 159/20*** | (2006.01) |
| ***C10N 10/02*** | (2006.01) |
| ***C10N 10/04*** | (2006.01) |
| ***C10N 30/04*** | (2006.01) |
| ***C10N 30/06*** | (2006.01) |
| ***C10N 30/10*** | (2006.01) |
| ***C10N 30/00*** | (2006.01) |
| ***C10N 40/25*** | (2006.01) |

(52) U.S. Cl.

CPC ..... *C10M 129/42* (2013.01); *C10M 133/16* (2013.01); *C10M 135/10* (2013.01); *C10M 159/20* (2013.01); *C10M 2207/26* (2013.01); *C10M 2215/08* (2013.01); *C10M 2215/28* (2013.01); *C10M 2219/044* (2013.01); *C10M 2219/046* (2013.01); *C10N 2010/02* (2013.01); *C10N 2010/04* (2013.01); *C10N 2030/04* (2013.01); *C10N 2030/06* (2013.01); *C10N 2030/10* (2013.01); *C10N 2030/52* (2020.05); *C10N 2040/25* (2013.01)

(58) Field of Classification Search

CPC ..... C10M 129/42; C10M 133/16; C10M 135/10; C10M 159/20; C10M 2207/26; C10M 2215/08; C10M 2215/28; C10M 2219/044; C10M 2219/046; C10N 2010/02; C10N 2010/04; C10N 2030/04; C10N 2030/06; C10N 2030/10; C10N 2030/52; C10N 2040/25

See application file for complete search history.

(56) References Cited

U.S. PATENT DOCUMENTS 10,577,555 B2 * 3/2020 Dowding ..... C10M 133/16

OTHER PUBLICATIONS

Wang, Y., Han, Y., Huang, X., Cao, M., Wang, Y., "Aggregation behaviors of a series of anionic sulfonate gemini surfactants and their corresponding monomeric surfactant", J. Colloid Interface Sci., 2008, 319, 534-541 (Year: 2008).*

* cited by examiner

*Primary Examiner* — James C Goloboy

(57) ABSTRACT

A metal-containing detergent, suitable for use as a lubricant additive, in the form of a concentrate in oil in which a basic metal-containing material is maintained in dispersion or solution in the oil by a gemini surfactant system comprising, or being derivable or derived from, a double bond-unsaturated carboxylic acid having 8 to 30 carbon atoms, the double bond or bonds of which being functionalized to carry polar groups across or on the double bond or bonds and the carboxylic acid group or groups thereof being functionalized to become an amide or ester group carrying at least one alkyl group having 4 to 20 carbon atoms.

15 Claims, 2 Drawing Sheets

Average friction coefficient of surfactants and base oil versus time from 40 °C to 140 °C. Vertical lines indicate an increment of 20 °C.

Average friction coefficient of surfactants and base oil versus time from 40 °C to 140 °C. Vertical lines indicate an increment of 20 °C.

LUBRICATING OIL ADDITIVES

FIELD OF THE INVENTION

This invention relates to metal detergent additives for use in lubricating oil compositions (lubricants) for lubricating the crankcase of spark-ignited or compression-ignited internal combustion engines. More specifically, it relates to detergents embracing gemini surfactants derived from natural products.

BACKGROUND OF THE INVENTION

Metal-containing or ash-forming detergents are widely used as additives in lubricating oil compositions (lubricants) for lubricating the crankcase of spark-ignited or compression-ignited internal combustion engines. Such additives may function to reduce or remove deposits and as acid neutralizers or rust inhibitors, thereby reducing wear and corrosion and extending engine life. They generally comprise a polar head with a long hydrophobic tail, the polar head comprising a metal salt of an acidic organic compound.

Conventionally, the acidic compound is derived from crude oil such as a sulfonic acid, a phenol or a salicylic acid.

This invention is concerned with detergents in which the acidic compound is derived from a natural product (such as oleic acid that is biocompatible and relatively low cost), and not from crude oil.

Surfactants are surface active agents. They are amphilic, meaning they contain two or more groups that are insoluble in each other. Structurally, they have a hydrophobic tail and a hydrophilic head.

Gemini surfactants ("Gemini" being a name assigned in 1991 to bis-surfactants) are sometimes called dimeric surfactants. They have more than one (usually two) hydrophilic head groups and more than one (usually two) hydrophobic groups in the molecule in contrast to conventional surfactants that generally have a single hydrophilic head group and a single hydrophobic group in the molecule.

The structure may or may not be symmetrical.

An example of a schematic representation of a Gemini surfactant is as follows:

| TAIL | - HEAD | - SPACER- | HEAD | - TAIL |
|---|---|---|---|---|
| (hydrophobic) | (hydrophilic; polar or ionic) | | (hydrophilic; polar or ionic) | (hydrophobic) |

The invention relates to use of gemini surfactant systems, i.e. dimers of monomeric surfactants linked with a spacer at the level of hydrophilic headgroups. The art contains many references to gemini surfactants. See, for example, J. Oleo. Sci. 60, (8) 411-417 (2011), "Oleic Acid-Based Gemini Surfactants with Carboxylic Acid Headgroups" by Kenichi Sakai et al. This reference describes their use only in aqueous systems and concludes that they may find application in the field of cosmetics, personal care, medicine, etc. No mention is made of non-aqueous application such as in lubricating oil compositions.

SUMMARY OF THE INVENTION

In a first aspect, the invention comprises a metal-containing detergent, such as an overbased detergent, suitable for use as a lubricant additive, in the form of a concentrate in oil in which a basic metal-containing material is maintained in dispersion or solution in the oil by a gemini surfactant system comprising, or being derivable or derived from, a double bond-unsaturated carboxylic acid having 8 to 30, such as 12 to 30, carbon atoms, the double bond or bonds thereof being functionalised to carry polar groups across or on the double bond or bonds and the carboxylic acid group or groups thereof being functionalised to become an amide or ester group carrying at least one alkyl group having 4 to 20 carbon atoms.

In a second aspect, the invention comprises a crankcase lubricating oil composition comprising an overbased detergent of the first aspect of the invention in a minor amount and an oil of lubricating viscosity in a major amount.

In a third aspect, the invention comprises a method of enabling an automotive crankcase lubricating oil composition to achieve improved friction reduction performance, comprising providing the composition with a minor amount of an additive of the first aspect of the invention.

In a fourth aspect, the invention comprises a method of lubricating surfaces in the crankcase of an internal combustion engine during its operation comprising (i) providing, in a minor amount, one or more detergent additives of the first aspect of the invention in a major amount of an oil of lubricating viscosity to make a lubricant;

(ii) providing the lubricant to the crankcase of an internal combustion engine;

(iii) providing a hydrocarbon fuel in the combustion chamber of the engine; and (iv) combusting the fuel in the combustion chamber.

In a fifth aspect, the invention comprises the use of a metal-containing detergent of the first aspect of the invention in a crankcase lubricating oil composition to improve the friction reduction and/or thermal and oxidative stability properties of the composition.

DETAILED DESCRIPTION OF THE INVENTION

Definitions

Figure 1:
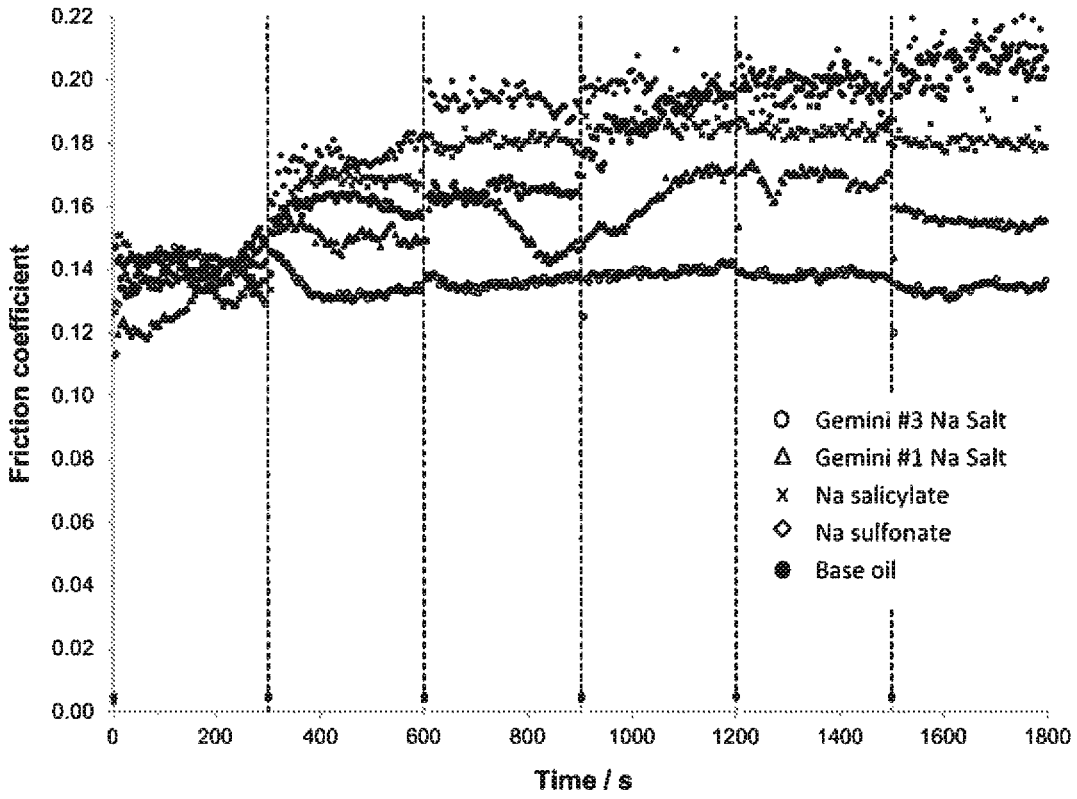
FIG. 1 shows graphically the friction-reducing properties of the gemini Na salts of the present invention in comparison to those of Na Sulfonate and Na Salicylate detergents.

In this specification, the following words and expressions, if and when used, have the meaning given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). The group may be unsaturated, and/or may be polymeric. Preferably, the hydrocarbyl group consists essentially of hydrogen and carbon atoms. More preferably, the hydrocarbyl group consists of hydrogen and carbon atoms. Preferably, the hydrocarbyl group is an aliphatic hydrocarbyl group, such as an alkyl group;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition;

"minor amount" means 50 mass % or less of a composition reckoned as active ingredient of the additive(s);

"effective amount" in respect of an additive means an amount of such an additive in the composition (e.g. an additive concentrate) that is effective to provide, and provides, the desired technical effect;

"ppm" means parts per million by mass, based on the total mass of the composition;

"metal content" of a composition or of an additive component, for example molybdenum content or total metal content of the additive concentrate (i.e. the sum of all individual metal contents), is measured by ASTM D5185;

"TBN" in relation to an additive component or of a composition, means total base number (mg KOH/g) as measured by ASTM D2896;

"$KV_{100}$" means kinematic viscosity at 100° C. as measured by ASTM D445; HTHS means High Temperature High Shear at 150° C. as measured by—CEC-L-36-A-90.

"phosphorus content" is measured by ASTM D5185;

"sulfur content" is measured by ASTM D2622;

"sulfated ash content" is measured by ASTM D874.

Also it will be understood that various components used, essential as well as optimal and customary, may react under condition of formulation, storage and use and that the invention also provides the product(s) obtainable or obtained by any such reaction.

Further it is understood that any upper and lower quality, range or ratio limits set forth herein may be independently combined.

Detergents

The detergents of the invention, and their method of preparation, are described in detail in the EXAMPLES section of this specification.

The double bond-unsaturated carboxylic acids from which they are derivable or derived may have one or more double bonds. A preferred example where the acid has one double bond is oleic acid and examples of acids with more than one double bond are linoleic acid and linoleic acid.

Examples of the polar group or groups are sulfonate and hydroxyl groups.

Preferably the detergents of the invention are free or substantially free of sulfur. They may be neutral or may be overbased. The metal may be a Group 1 metal such as sodium or a Group 2 metal such as calcium.

The surfactant system of the detergent preferably comprises a 4,4'-(1-(dialkylamino)-1-oxooctadecene-9,10-diyl) bis(oxy)-(4-oxobutanoate)) anion, where each alkyl group has from 4 to 20 carbon atoms.

Lubricating Compositions

Lubricating compositions of the invention may be lubricants suitable for use as motor vehicle motor oils comprising a major amount of oil of lubricating viscosity and minor amounts of performance-enhancing additives, including the detergent material. The lubricating composition may also be in the form of an additive concentrate for blending with oil of lubricating viscosity to make a final lubricant.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making additive concentrates as well as for making lubricating oil compositions therefrom, may be selected from natural oils (vegetable, animal or mineral) and synthetic lubricating oils and mixtures thereof.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998, which categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

Typically, the base stock has a viscosity preferably of 3-12, more preferably 4-10, most preferably 4.5-8, $mm^2/s$ at 100° C.

TABLE E-1

| Analytical Methods for Base Stock | |
|---|---|
| Property | Test Method |
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity that may be included in the lubricating oil composition are detailed as follows.

Natural oils include animal and vegetable oils (e.g. castor and lard oil), liquid petroleum oils and hydro-refined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oil comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oils. Refined oils are similar to the unrefined oils except they have been further treated in one or more purification steps to improve one or more properties. Many such purification techniques, such as distillation, solvent extraction, acid or base extraction, filtration and percolation, are known to those skilled in the art. Re-refined oils are obtained by processes similar to those used to obtain refined oils applied to refined oils that have been already used in service. Such re-refined oils are also known as reclaimed or reprocessed oils and are often additionally processed by techniques for treating spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil of lubricating viscosity may also comprise a Group I, Group IV or Group V base stocks or base oil blends of the aforementioned base stocks.

Co-Additives

The lubricating oil compositions of all aspects of the present invention may further comprise one or more phosphorus-containing compounds; oxidation inhibitors or antioxidants; dispersants; other metal detergents; and other co-additives, provided they are different from the additives of the invention. These will be discussed in more detail below.

Suitable phosphorus-containing compounds include dihydrocarbyl dithiophosphate metal salts, which are frequently used as antiwear and antioxidant agents. The metal is preferably zinc, but may be an alkali or alkaline earth metal, or aluminum, lead, tin, molybdenum, manganese, nickel or copper. The zinc salts are most commonly used in lubricating oil in amounts of 0.1 to 10, preferably 0.2 to 2, mass %, based upon the total weight of the lubricating oil composition. They may be prepared in accordance with known techniques by first forming a dihydrocarbyl dithiophosphoric acid (DDPA), usually by reaction of one or more alcohols or a phenol with $P_2S_5$, and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the other(s) are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil-soluble salts of dihydrocarbyl dithiophosphoric acids and may be represented by the following formula:

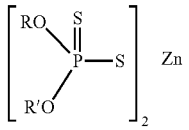

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. in R and R') in the dithiophosphoric acid will generally be 5 or greater. The zinc dihydrocarbyl dithiophosphate (ZDDP) can therefore comprise zinc dialkyl dithiophosphates. Lubricating oil compositions of the present invention may suitably have a phosphorus content of no greater than about 0.08 mass % (800 ppm). Preferably, in the practice of the present invention, ZDDP is used in an amount close or equal to the maximum amount allowed, preferably in an amount that provides a phosphorus content within 100 ppm of the maximum allowable amount of phosphorus. Thus, lubricating oil compositions useful in the practice of the present invention preferably contain ZDDP or other zinc-phosphorus compounds, in an amount introducing from 0.01 to 0.08, such as from 0.04 to 0.08, preferably from 0.05 to 0.08, mass % of phosphorus, based on the total mass of the lubricating oil composition.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters preferably having $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil-soluble copper compounds as described in U.S. Pat. No. 4,867,890, and molybdenum-containing compounds.

Aromatic amines having at least two aromatic groups attached directly to the nitrogen atom constitute another class of compounds that is frequently used for antioxidancy. Typical oil-soluble aromatic amines having at least two aromatic groups attached directly to one amine nitrogen atom contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen atom are also considered aromatic amines having at least two aromatic groups attached directly to the nitrogen atom. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 mass %.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants in this invention are preferably "ashless", as mentioned above, being non-metallic organic materials that form substantially no ash on combustion, in contrast to metal-containing and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated or oxylated. For example, boration may be accomplished by treating an acyl nitrogen-containing dispersant with a boron compound selected from boron oxide, boron halides, boron acids and esters of boron acids.

Preferably, the dispersant, if present, is a succinimide-dispersant derived from a polyisobutene of number average molecular weight in the range of 1000 to 3000, preferably 1500 to 2500, and of moderate functionality. The succinimide is preferably derived from highly reactive polyisobutene.

Another example of dispersant type that may be used is a linked aromatic compound such as described in EP-A-2 090 642.

A detergent is an additive that reduces formation of piston deposits, for example high-temperature varnish and lacquer deposits in engines; it normally has acid-neutralising properties and is capable of keeping finely-divided solids in suspension. Most detergents are based on metal "soaps", that is metal salts of acidic organic compounds.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a total base number or TBN at 100% active mass (as may be measured by ASTM D2896) of from 0 to 80. Large amounts of a metal base can be included by reaction of an excess of a metal compound, such as an oxide or hydroxide, with an acidic gas such as carbon dioxide.

The resulting overbased detergent comprises neutralised detergent as an outer layer of a metal base (e.g. carbonate) micelle. Such overbased detergents may have a TBN at 100% active mass of 150 or greater, and typically of from 200 to 500 or more.

Suitably, detergents that may be used include oil-soluble neutral and overbased sulfonates, phenates, sulfurised phenates, thiophosphonates, salicylates and naphthenates and other oil-soluble carboxylates of a metal, particularly alkali metal or alkaline earth metals, e.g. Na, K, Li, Ca and Mg. The most commonly-used metals are Ca and Mg, which may both be present in detergents used in lubricating compositions, and mixtures of Ca and/or Mg with Na. Detergents may be used in various combinations.

Additional additives may be incorporated into the compositions of the invention to enable particular performance requirements to be met. Examples of such additives which may be included in the lubricating oil compositions of the present invention are metal rust inhibitors, viscosity index improvers, corrosion inhibitors, oxidation inhibitors, other friction modifiers, anti-foaming agents, anti-wear agents and pour point depressants. Some are discussed in further detail below.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with dials, for example, the butane diol ester of a dimerized unsaturated fatty acid; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(R''OCS_2)_4 \text{ and } Mo(R''SCS_2)_4$$

wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron-donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Lubricating oil compositions useful in all aspects of the present invention preferably contain at least 10, at least 30, at least 40 and more preferably at least 50, ppm molybdenum. Suitably, lubricating oil compositions useful in all aspects of the present invention contain no more than 1000, no more than 750 or no more than 500, ppm of molybdenum. Lubricating oil compositions useful in all aspects of the present invention preferably contain from 10 to 1000, such as 30 to 750 or 40 to 500, ppm of molybdenum (measured as atoms of molybdenum).

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from 5,000 to 250,000, preferably from 15,000 to 200,000, more preferably from 20,000 to 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

Pour point depressants (PPD), otherwise known as lube oil flow improvers (LOFIs) lower the lowest temperature at which the lube flows. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohols, to form multi-functional additives.

In the present invention it may be necessary to include an additive that maintains the stability of the viscosity of the blend. Thus, although polar group-containing additives achieve a suitably low viscosity in the pre-blending stage, it has been observed that some compositions increase in viscosity when stored for prolonged periods. Additives that are effective in controlling this viscosity increase include the long chain hydrocarbons functionalized by reaction with mono- or dicarboxylic acids or anhydrides, which are used in the preparation of the ashless dispersants as hereinbefore disclosed.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values since the detergents are used in the form of colloidal dispersants in an oil) are stated as mass percent active ingredient (A.I.).

| ADDITIVE | MASS % (Broad) | MASS % (Preferred) |
|---|---|---|
| Dispersant | 0.1-20 | 1-8 |
| Metal Detergents | 0.1-15 | 0.2-9 |
| Corrosion Inhibitor | 0-5 | 0-1.5 |
| Metal dihydrocarbyl dithiophosphate | 0.1-6 | 0.1-4 |
| Antioxidant | 0-5 | 0.01-2.5 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Base stock | Balance | Balance |

Preferably, the Noack volatility of the fully-formulated lubricating oil composition (oil of lubricating viscosity plus all additives) is no greater than 18, such as no greater than 14, preferably no greater than 10, mass %. Lubricating oil compositions useful in the practice of the present invention may have an overall sulfated ash content of from 0.5 to 2.0, such as from 0.7 to 1.4, preferably from 0.6 to 1.2, mass %.

It may be desirable, although not essential, to prepare one or more additive concentrates comprising additives (concentrates sometimes being referred to as additive packages) whereby several additives can be added simultaneously to the oil to form the lubricating oil composition.

EXAMPLES

The invention will now be particularly described in the following non-limiting examples.

Structures Investigated

Three different Gemini surfactants and three salts were produced:

Gemini #1: N,N-dihexyl-9,10-dihydroxyoctadecanamide.

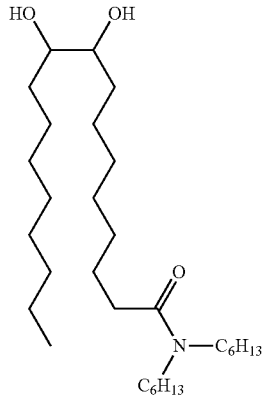

Gemini #2: 4,4'-((1-(dihexylamino)-1-oxooctadecane-9,10-diyl)bis(oxy))bis(4-oxobutanoic acid)

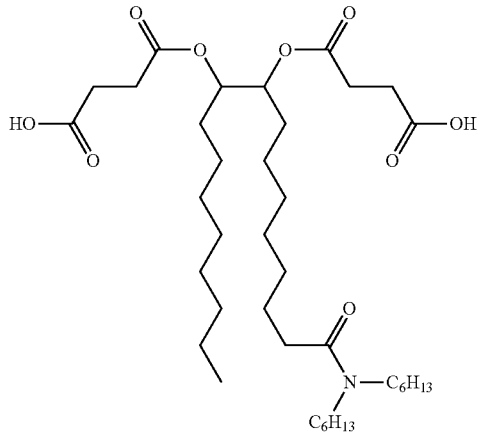

Gemini #3: 4,4'-((1-(didecylamino)-1-oxooctadecane-9,10-diyl)bis(oxy))bis(4-oxobutanoic acid)

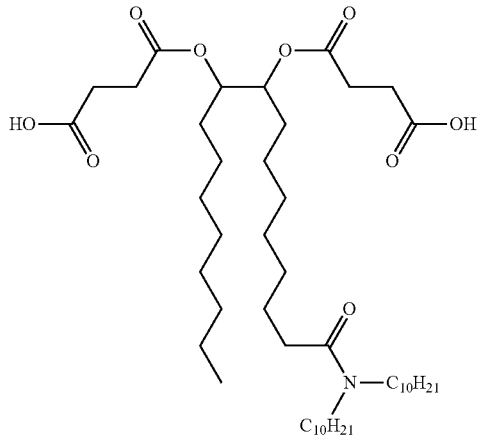

The three Gemini Surfactants were reacted further to form metallic salts:

Gemini #1 Na Salt: sodium 18-(dihexylamino)-10-hydroxy-18-oxooctadecane-9-sulfonate

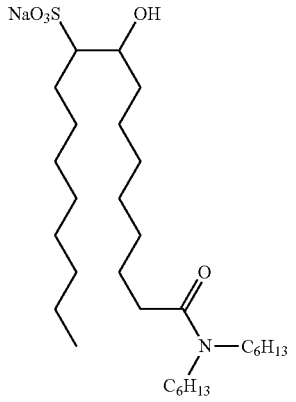

Gemini #2 Na Salt: sodium 4,4'-((1-(dihexylamino)-1-oxooctadecane-9,10-diyl)bis(oxy))bis(4-oxobutanoate)

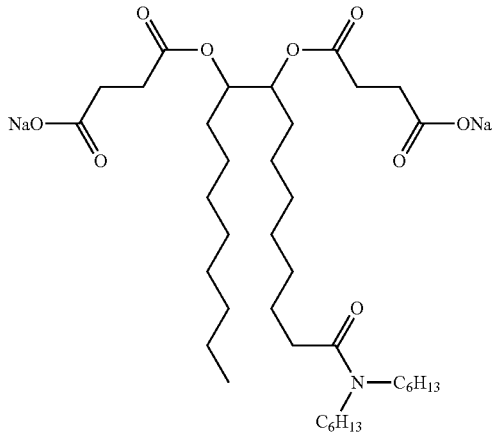

Gemini #3 Na Salt: sodium 4,4'-((1-(didecylamino)-1-oxooctadeeane-9,10-diyl)bis(oxy))bis(4-oxobutanoate)

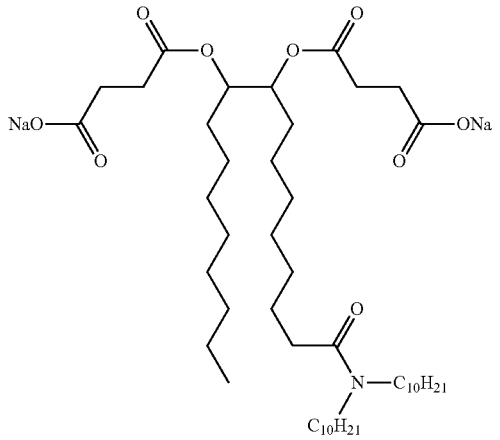

Surfactant Synthesis

Gemini surfactants were synthesised from oleoyl chloride by reaction with a dialkylamine (either dihexylamine or didecylamine) to form an amide. All chemicals were purchased from Sigma Aldrich or Fisher and used without further purification.

Formation of N,N-didecyloleamide

Didecylamine (22.66 g, 76 mmol) and triethylamine (7.74 g, 76 mmol) in heptane (800 ml) were added to an oven-dried reaction vessel purged with nitrogen. Oleoyl chloride (19.88 g, 66 mmol) diluted in heptane (20 ml) was added to this mixture over 2 hours. The reaction vessel was cooled to maintain a temperature below 26° C. The resulting mixture was stirred at room temperature for 90 minutes. Triethylammonium chloride was removed by vacuum filtration. The yellow filtrate was extracted with 5% (w/w) hydrochloric acid solution and brine (3×200 ml), dried over magnesium sulfate, filtered and concentrated under reduced pressure with >90% yield.

Formation of N,N-didecyl-8-(3-octyloxiran-2-yl)octanamide

N, N-didecyloleamide (5.9 g, 10.53 mmol) and 3-chloroperbenzoic acid (2.9 g, 16.9 mmol) in dichloromethane (50 ml) were stirred at room temperature for 4 hours. The organic layer was then extracted with bicarbonate solution (3×15 ml), water (3×15 ml) and brine solution (40 ml) then dried over magnesium sulfate and concentrated under reduced pressure to yield N,N-didecyl-8-(3-octyloxiran-2-yl)octanamide as a yellow oil (4.63 g, 8 mmol, 76%).

Formation of N,N-didecyl-9,10-dihydroxyoctadecanamide

N,N-didecyl-8-(3-octyloxiran-2-yl) octanamide (3.47 g, 6 mmol) and p-toluenesulfonic acid monohydrate (0.065 g, 0.34 mmol) in THF:Water (50 ml, Ratio 9:1) were heated under reflux for 4 hours. Further p-toluenesulfonicacid was added (0.065 g, 0.34 mmol) and the mixture was again heated under reflux for 7 hours. The reaction was added to a sodium carbonate solution (10 wt. % in $H_2O$, 30 ml) and the THF removed under reduced pressure. The aqueous layer was then extracted with dichloromethane (4×50 ml). The organic layers were then collected, extracted with water (4×40 ml), dried over magnesium sulfate and concentrated under reduced pressure to afford N,N-didecyl-9,10-dihydroxyoctadecanamide as a yellow oil (1.9 g, 3.2 mmol, 53%).

In some cases this product was reacted further with succinic anhydride to form the bisoxo acid.

Formation of 4,4'-((1-(didecylamino)-1-oxooctadecane-9,10-diyl)bis(oxy))bis(4-oxobutanoic Acid):

N,N-didecyl-9,10-dihydroxyoctadecanamide (1.9 g, 3 mmol), succinic anhydride (0.8 g, 8 mmol), triethylamine (0.8 g, 8 mmol) and 4-dimethylaminopyridine (0.003 g, 0.032 mmol) in toluene (100 ml) were stirred at 80° C. for 24 hours. The resulting mixture was allowed to cool to 70° C. and hydrochloric acid (2 M, 40 ml) was added and stirred for 3 hours. The organic layer was extracted with distilled water (2×20 ml), dried over magnesium sulfate and concentrated under reduced pressure to afford 4,4'-((1-(didecylamino)-1-oxooctadecane-9,10-diyl)bis(oxy))bis(4-oxobutanoic acid) as a yellow oil (1.9 g, 2.4 mmol, 75%).

The synthetic route developed to obtain carboxylic-type Gemini surfactants is shown in the reaction scheme below.

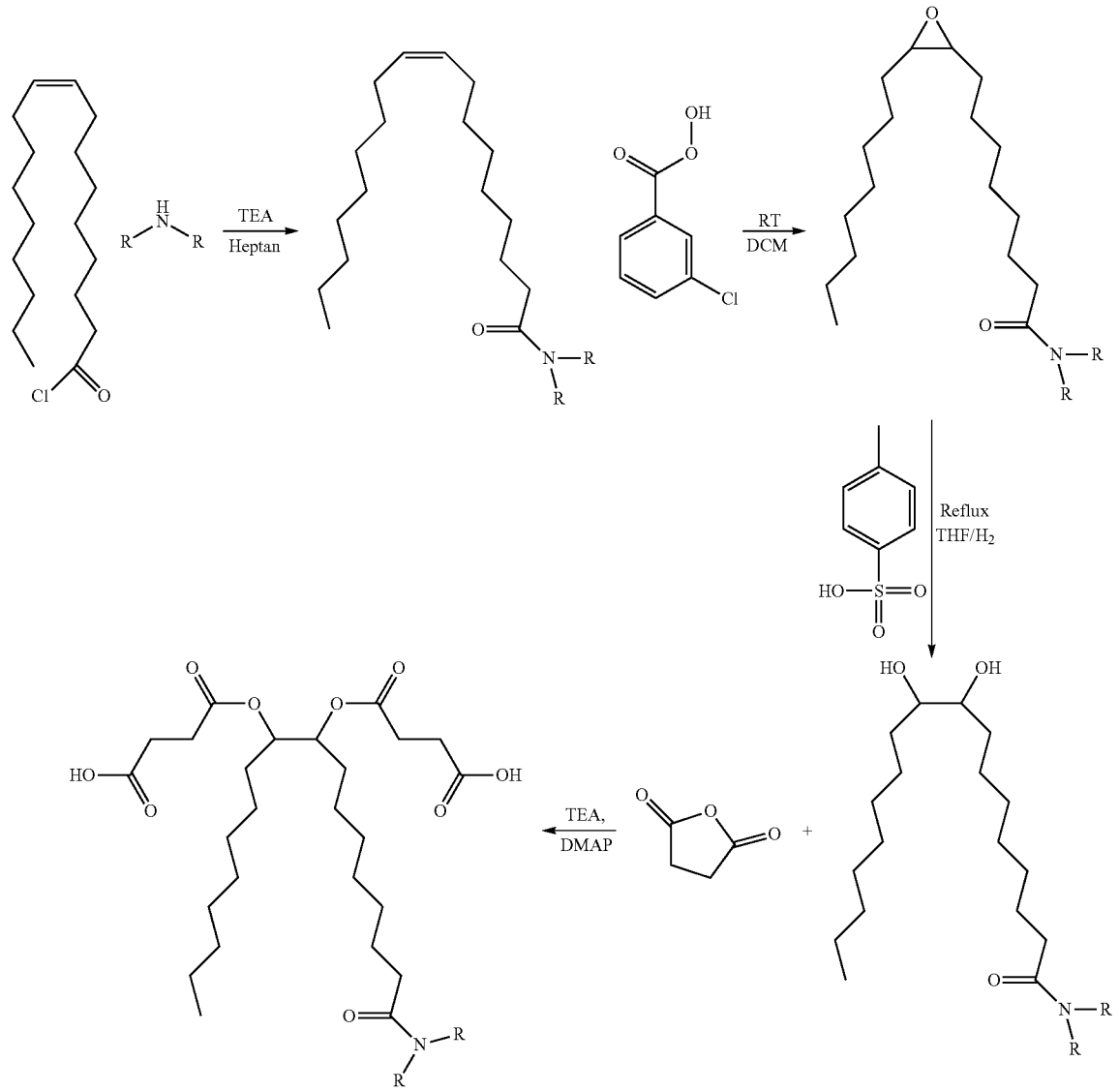

Formation of Metallic Salts

Sodium 18-(dihexylamino)-10-hydroxy-18-oxooctadecane-9-sulfonate

Diethyl ether (100 mL, anhydrous) was stirred under nitrogen and cooled to 5° C. by use of an ice bath. Chlorosulfonic acid, (3.38 mL, 5.92 g, 78 mmol) was added dropwise via a dropping funnel over 1 h, maintaining a temperature below 10° C. A mixture of N,N-dihexyl-9,10-dihydroxyoctadecanamide (5 g, 12.26 mmol) in diethyl ether (80 mL, anhydrous) was added steadily to the mixture, the ice bath removed, and the temperature allowed to rise to room temperature over approximately 3 h. This mixture was then transferred to a dropping funnel and added steadily to a mixture of sodium carbonate (15 g) and deionised water (50 g) under vigorous stirring. The pH of the mixture was kept above 7 to prevent dehydration of the intermediate during the addition, and was monitored with litmus paper. After addition was complete, the mixture was transferred to a separating funnel and the phases separated. The organic phase was washed with two portions of water (20 mL) and brine (20 mL). The organic phase was then concentrated in vacuo at 60° C. and dried by co-distilling with toluene at 90° C. to afford the sodium hydroxy sulfonate of 2-ethylhexyloleamide (5.77 g, 91%) as a yellow viscous liquid;

Sodium 4,4'-((1-(didalkylamino)-1-oxooctadecane-9,10-diyl)bis(oxy))bis(4-oxobutanoate):

4,4'-((1-(didecylamino)-1-oxooctadecane-9,10-diyl)bis(oxy))bis(4-oxobutanoic acid) (5.81 g, 7.3 mmol) in xylene (100 g) was added to sodium bicarbonate (1.23 g, 14.6 mmol) in distilled water (23 g) and the mixture was slowly stirred at RT for 1 h. The organic phase was dried over magnesium sulfate and concentrated under reduced pressure to afford 2d as a yellow solid.

Sodium 4,4'-((1-(didecylamino)-1-oxooctadecane-9,10-diyl)bis(oxy))bis(4-oxobutanoate) (2d): yellow solid (76% yield).

For comparison of performance, neutral (sodium or calcium) salts of sulfonate and salicylate based on a linear C12 tail were also investigated.

In addition, a sample of overbased calcium phenate was also investigated.

Overbased Detergent Synthesis

Samples of Gemini #3 were used to produce overbased calcium detergents (detailed below).

| | Gemini #3 CaOBD |
|---|---|
| Acid (soap) content (mmol H+ $g^{-1}$) | 0.51 |
| TBN (mgKOH $g^{-1}$) | 237 |
| Degree of carbonation | 97 |

For comparison of performance, overbased calcium salicylate (TBN of 350 mgKOH $g^{-1}$) and overbased calcium sulfonate (TBN of 300 mgKOH $g^{-1}$) were also investigated.

EXAMPLES

Comparative Example 1

Friction Performance

Friction performance was determined using a PCS Instruments high frequency reciprocating rig (HFRR) using a ball (6.0 mm diameter) and disk contact and 2.5 ml sample. A step ramp profile was run with the ball reciprocating at 40 Hz for 5 minutes at 40, 60, 80, 100, 120 and 140, ° C. at 1000 μm stroke length with a 400 g load on the ball. A stable temperature (1 minute) was required before reciprocation started. Measurements were taken every 5 seconds during the reciprocating action. Samples were prepared at a fixed surfactant concentration (0.195 mmol) dispersed in oil (XOMAPE150) by stirring at 300 rpm for 1 hour at 60° C. All samples were run in duplicate on the same profile. The full results are shown in FIG. 1.

Variation of the averaged friction coefficient with time was observed. The reduction in friction every 300 seconds corresponded to heating stages between temperatures and were higlighted by the dashed lines. These data points were not included in the following calculations. Due to the operational temperature of the engine, friction performance at 140° C. are most interesting to consider. From TGA results (see below) the temperature was low enough to ensure results were not influenced by thermal degradation of the surfactants.

| Component | Average friction coefficient (140° C.) |
|---|---|
| Gemini #3 Na Salt | 0.1337 |
| Gemini #1 Na Salt | 0.1555 |
| Na salicylate | 0.1809 |
| Na sulfonate | 0.2095 |
| Base oil | 0.2027 |

Average Friction Coefficient of Surfactants and Base Oil Measured in Duplicate for 300 Seconds at 140° C.

The average friction coefficients from the two runs of each sample together with the standard errors, derived from the standard deviation, were calculated from measurements at 140° C. for each blend. The average friction coefficients of Na salicylate, Gemini #1 Na Salt and Gemini #3 Na Salt surfactants were reduced by 10, 23 and 34% respectively, compared with base oil. An increase of 3% in friction was observed for the sodium sulfonate surfactant (compared with a base oil reference). The Gemini surfactants show enhanced frictional performance friction compared with the more conventional chemistry of surfactants. Gemini #3 Na Salt showed the best frictional performance.

Figure 2:
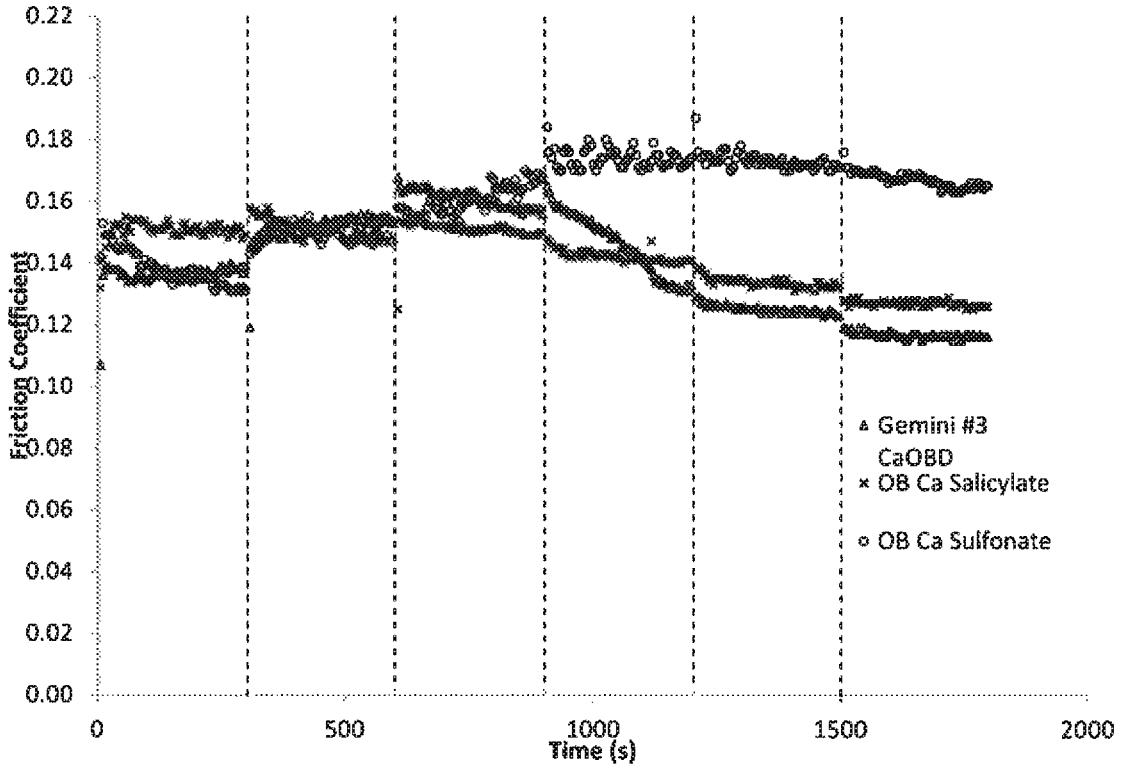
FIG. 2 shows graphically the friction-reducing properties of the gemini Ca salts of the present invention in comparison to those of Ca Sulfonate and Ca Salicylate detergents.

The frictional performance of samples of overbased calcium detergents is shown in FIG. 2. For each system, samples were investigated at a constant surfactant concentration (0.195 mmol).

| Component | Average friction coefficient (140° C.) |
|---|---|
| Gemini #3 CaOBD | 0.11 |
| OB Ca salicylate | 0.12 |
| OB Ca sulfonate | 0.16 |

Average Friction Coefficient of Overbased Detergents measured in Duplicate for 300 Seconds at 140° C.

When present as overbased detergents, Gemini surfactants provide enhanced friction, with improved performance over conventional detergents.

Comparative Example 2

Thermal/Oxidative Stability

Thermo-gravimetric analysis (TGA) was used for assessing the thermal and oxidative stability of the Gemini surfactants. The products can be tested neat, which removes the need to account for secondary effects caused by solvents or presence of other species.

The TGA measured the weight loss of the sample with increasing temperature. The rate of change of weight was calculated. The onset, peak and offset (TON, TOX, TOFF) of such changes in the rate of weight loss are referred to as a thermal event. Knowledge of the molecular weight and the percentage weight loss during a thermal event allows estimation of the fraction lost by the compound under investigation. TGA was used to determine the temperature at which the surfactants are considered to stop functioning. Performing the experiments in an oxygen atmosphere also allows oxidation of the investigated compounds to be determined. Calcium salts of sulfonate and salicylate surfactants and overbased calcium phenate were run at 50 active ingredient, dispersed in base oil.

| Compound | Thermal stability TOX1/° C. | Oxidative stability TOX1/° C. |
|---|---|---|
| Gemini #2 | 266 | 266 |
| Gemini #3 | 350 | 330 |
| Gemini #2 Na Salt | 311 | 311 |
| Gemini #3 Na Salt | 331 | 317 |
| Gemini #1 Na Salt | 198 | 200 |
| Ca Sulfonate | 261 | 262 |
| Ca Salicylate | 247 | 246 |
| Ca Phenate O/B | 250 | 248 |

Summary of thermal and oxidative stability temperatures and corresponding ash values for synthesised and commercial surfactants from TGA results. TOX1 refers to the first thermal event.

The thermal stability refers to the first thermal event and is quoted as the inflection point of the rate of change of mass loss (TOX1). The first thermal event was associated with 50-90% weight losses at which point the surfactant is regarded as having lost its functionality. This was true for all samples measured, except for Gemini #2 (TOX1=17%, 115 g $mol^{-1}$) and Gemini #1 Na Salt (TOX1=5%, 29 g $mol^{-1}$), which can be associated with loss of alkyl chain or part of the head group.

From the TGA results it appears that the carboxylic acid type gemini surfactants were more thermally stable compared with the more conventional surfactants In an oxygen atmosphere, TOX1 values showed improved oxidative stability for the sodium salts of carboxylic acid-type gemini surfactants compared with sulfonate, salicylate and phenate.

What is claimed is:

1. A crankcase lubricating oil composition comprising:

a major amount of an oil of lubricating viscosity; and a minor amount of a metal-containing detergent, in the form of a concentrate in oil as a dispersion or a solution, comprising a gemini surfactant system derived from a $C_8$-$C_{30}$ double bond-unsaturated carboxylic acid, which double bond has been functionalized to form at least one polar group and which carboxylic acid has been functionalized to form an amide or ester group having at least one $C_4$-$C_{20}$ alkyl group.

2. The composition of claim 1, further comprising minor amounts of one or more other additives, different from said detergent, which additives are ashless dispersants, metal detergents, corrosion inhibitors, antioxidants, pour point depressants, antiwear agents, friction modifiers, demulsifiers, antifoamants, viscosity modifiers, and combinations thereof.

3. A method of improved friction reduction performance of a crankcase lubricating oil composition, which method comprises formulating the composition to contain a minor amount of a metal-containing detergent, in the form of a concentrate in oil as a dispersion or a solution, comprising a gemini surfactant system derived from a $C_8$-$C_{30}$ double bond-unsaturated carboxylic acid, which double bond has been functionalized to form at least one polar group and which carboxylic acid has been functionalized to form an amide or ester group having at least one $C_4$-$C_{20}$ alkyl group.

4. A method of lubricating surfaces in the crankcase of an internal combustion engine during its operation, the method comprising:

(i) providing a crankcase lubricating oil composition according to claim 1;

(ii) providing the composition to the crankcase of an internal combustion engine;

(iii) providing a hydrocarbon fuel in a combustion chamber of the engine; and (iv) combusting the fuel in the combustion chamber.

5. The composition of claim 1, wherein the $C_8$-$C_{30}$ unsaturated carboxylic acid of the gemini surfactant system had only one double bond.

6. The composition of claim 1, wherein the at least one polar group of the gemini surfactant system is a sulfonate and/or a hydroxyl group.

7. The composition of claim 5, wherein the at least one polar group of the gemini surfactant system is a sulfonate and/or a hydroxyl group.

8. The composition of claim 1, wherein the gemini surfactant system is sulfur-free or substantially sulfur-free.

9. The composition of claim 1, wherein the detergent metal is a Group 1 or Group 2 metal.

10. The composition of claim 9, wherein the metal comprises calcium.

11. The composition of claim 1, wherein the detergent comprises an overbased detergent.

12. The composition of claim 1, wherein the detergent comprises a neutral detergent.

13. The composition of claim 1, wherein the gemini surfactant system comprises a 4,4'-(1-(dialkylamino)-1-oxooctadecane-9,10-diyl)bis(oxy)-(4-oxobutanoate)) anion, and wherein each alkyl group in the dialkylamino moiety comprises from 4 to 20 carbon atoms.

14. The composition of claim 1, where the double bond-unsaturated carboxylic acid of the gemini surfactant system was a $C_{12}$-$C_{30}$ acid.

15. The composition of claim 5, wherein the double bond-unsaturated carboxylic acid of the gemini surfactant system was derived from oleic acid.

* * * * *